US009338860B2

(12) United States Patent
Radermacher

(10) Patent No.: US 9,338,860 B2
(45) Date of Patent: May 10, 2016

(54) POWER OVER ETHERNET LIGHTING DEVICE

(75) Inventor: Harald Josef Günther Radermacher, Aachen (DE)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 582 days.

(21) Appl. No.: 13/505,767

(22) PCT Filed: Oct. 29, 2010

(86) PCT No.: PCT/IB2010/054909

§ 371 (c)(1), (2), (4) Date: May 3, 2012

(87) PCT Pub. No.: WO2011/055284

PCT Pub. Date: May 12, 2011

(65) Prior Publication Data

US 2012/0223650 A1 Sep. 6, 2012

(30) Foreign Application Priority Data

Nov. 6, 2009 (EP) ..... 09175215

(51) Int. Cl.
*H05B 37/02* (2006.01)

(52) U.S. Cl.
CPC ..... *H05B 37/0254* (2013.01)

(58) Field of Classification Search
CPC ..... H05B 37/02; H05B 33/08
USPC ..... 315/200 R, 224, 291, 307, 308
See application file for complete search history.

(56) References Cited

U.S. PATENT DOCUMENTS

| | | | | |
|---|---|---|---|---|
| 7,587,289 | B1 | 9/2009 | Sivertsen | |
| 2007/0263333 | A1* | 11/2007 | Apfel | 361/91.1 |
| 2008/0030185 | A1* | 2/2008 | Metsker et al. | 323/304 |
| 2008/0197790 | A1* | 8/2008 | Mangiaracina et al. | 315/312 |

FOREIGN PATENT DOCUMENTS

| | | | |
|---|---|---|---|
| DE | 102006006140 | A1 | 8/2007 |
| JP | 2007317573 | A | 12/2007 |
| JP | 2008084614 | A | 4/2008 |
| JP | 2008521367 | A | 6/2008 |

OTHER PUBLICATIONS

Pascal Unterdorfer, Power over Ethernet, Jun. 30, 2008, pp. 3-6.*

(Continued)

*Primary Examiner* — Douglas W Owens
*Assistant Examiner* — Thai Pham
(74) *Attorney, Agent, or Firm* — Meenakshy Chakravorty

(57) ABSTRACT

Information technology is becoming more and more present in illumination applications, such as lighting devices. To limit the installation effort and cost of such illumination applications lighting devices compliant with the Power over Ethernet can be used. There is provided a lighting device which is powered via Power over Ethernet and where the driver of the lighting device is directly compatible with the Power over Ethernet standard. With such an internal Power over Ethernet driver, the power delivered to the light source of the lighting device can be influence gradually, thereby allowing the light source to operate at a different power level instead of shutting the light source down completely.

20 Claims, 5 Drawing Sheets

(56) References Cited

OTHER PUBLICATIONS

Galit Mendelson, All you need to know about Power over Ethernet (POE) and the IEEE 802.3af Standard, Jun. 2004, PowerDsine, pp. 12-16.*

LM5070 Integrated Power over Ethernet PD Interface and PWM Controller, Dec. 2004, National Semiconductor, pp. 10-14.*

NCP1082: "Integrated PoE-PD & DC-DC Converter Controller With 9 V Auxiliary Supply Support", Semiconductor Components Industries. LLC, Nov. 2008, pp. 1-16.

"10W Power Over Ethernet LED Drice", http://www.convertertechnology.co.uk/index.php?c=Reference_Design &s=60reference.

Chris Richardson; "PoE and LED: Together at Last", Applications Engineer National Semiconductor, LED Journal, Jan./Feb. 2008, pp. 2-6.

"LM5070 Integrated Power Over Ethernet PD Interface and PWM Controller DS201200", National Semiconductor Corp., Apr. 2006, pp. 1-17, XP002637515.

* cited by examiner

POWER OVER ETHERNET LIGHTING DEVICE

FIELD OF THE INVENTION

The present invention relates in general to a lighting device comprising at least one light source, and in particular to a lighting device compatible with a power over Ethernet standard.

BACKGROUND OF THE INVENTION

Information technology is becoming more and more present in building information applications. Examples and applications include energy saving which may be accomplished by combining and processing information available from a information technology network of the building. By using these information technology networks also control of illumination of the building may be more and more integrated. To limit the installation effort and cost in a building, it could be advantageous to use one electric cable for several purposes. Such an electrical cable could be used for both provision of power and communications. One such example is power-line communications. Another example is to use the IEEE standard Power over Ethernet (PoE) defined according to IEEE 802.3af. This standard defines the interaction between power sourcing equipment (PSE) and power devices (PD). One Ethernet cable can transport both data and power (e.g. 13 W) to the PD. Making use of efficient solid state lighting (SSL) sources, such as light emitting diodes (LEDs), the power delivered by one Ethernet cable will be sufficient (with the LEDs approaching 200 lm/W) to illuminate e.g. a work desk or another limited office space, such as an area next to a printer. On the market, there are certain PD controllers available, typically as integrated circuits. These PD controllers are attached as an interface between the lighting device to be controlled and the Ethernet cable. One example of such an integrated circuit is the LM5073 circuit from National Semiconductor. A drawback is that the PD controller adds cost, volume and losses to the circuitry of the lighting device to be controlled.

As noted above, PD controllers can be used in lighting contexts. Particularly, PD controller may be used to control lighting devices. PD controllers according to prior art have the possibility to shut down the lighting device by two means. Firstly, according to the PoE standard there is a shut down signal commanding the lighting device not to conduct any current. Secondly, the PD controller can cut the power flow to the lighting device by means of an internal switch. In both cases, any activity of the controller will lead to undesired effects on the light output.

SUMMARY OF THE INVENTION

It is an object of the present invention to overcome this problem, and to provide an improved lighting device comprising internal PoE compliant driver circuitry.

It is an object of the present invention to provide a lighting device that fulfills most or all the requirements of a PD, without the need for an initial power processing step being performed by a dedicated PD controller.

Generally, the above objectives are achieved by a lighting device according to the attached independent claim. According to a first aspect of the invention, this and other objects are achieved by a lighting device comprising at least one light source, the lighting device comprising driver circuitry to: conduct a first predefined current within at least one predefined classification current range upon receiving a classification voltage within a classification voltage range, and conduct a second predefined current upon receiving an operation voltage, wherein a power consumed at the operation voltage is within at least one predefined power consumption class, the classification current range being associated with the power consumption class, wherein the first predefined current and the second predefined current are defined by at least one from a group of forward voltage characteristics of the light source, a property of a voltage dropping device connected to the lighting device, a property of a current drawing device connected to the lighting device and characteristics of a power converter configured to deliver an output voltage, which differs from the input voltage, to the light source.

Advantageously such a lighting device allows the supply power to the light source to be influenced gradually. Thereby the light source is enabled to operate at different power levels instead of being completely shut down. In case of utilizing the forward voltage characteristics of the light source to set the minimum voltage that allows a current flow, certain voltage monitoring circuitry, which would normally be present in the PD controller, are no longer required. In case of utilizing the current limiting functionality of the power converter to set the maximum current, neither current measurement means and nor a series switch (which has to carry the complete device current) are required.

According to an embodiment the voltage dropping device is connected in series with the light source. Advantageously the voltage dropping device may be used to reduce the voltage over the light source thereby stabilizing the conducted current with respect to input voltage and forward voltage variation.

According to an embodiment the current drawing device is connected parallel to the light source. Advantageously the current drawing device may be used to provide a parallel current path for the device current which is controlled independently or dependently from the light source current.

According to an embodiment the first predefined current and the second predefined current are determined by properties of the light source.

According to an embodiment lighting device is arranged to receive power from a power source, and wherein the at least one predefined power consumption class and the at least one predefined classification current range are determined by properties of the power source. Advantageously the lighting device is enabled to, by consuming a certain current during classification, communicate its classification class to the power device.

According to an embodiment the lighting device further comprises an energy storage arranged to selectively store power and power the light source. Advantageously the energy store may further prevent the light source from completely shutting off due to the supply power level being too low.

According to an embodiment the lighting device further comprises driver circuitry configured to: scale the input power to an output power; provide a signal processing unit with the output power; from the signal processing unit, receive a control signal pertaining to a power level of the light source; and adapt the output power to the light source according to the control signal. Advantageously such a lighting device may be able to communicate information, whereby this information can be used to control the lighting device.

According to an embodiment the control signal comprises modulated data. Thereby the signal may be able to carry large amounts of information (in comparison to an un-modulated or analogue signal merely having a certain voltage level). Advantageously this may allowed improved communication.

According to an embodiment the data is associated with a property of the light source. Advantageously, by considering the data the control of the light source may be improved.

According to an embodiment the lighting device further comprises driver circuitry configured to: measure at least one property of the lighting device; and provide the signal processing unit with the measurement. Advantageously this may enable further improved control of the lighting device.

According to an embodiment the driver circuitry comprises a switched mode power supply from a group of a step-up converter and a step-down converter. Advantageously this allows for simple implementation of the lighting device.

According to an embodiment the lighting device further comprises a rectifier arranged to rectify input current conducted by the lighting device. This provides a compact lighting device not requiring external rectifier circuitry. Advantageously this provides a plug-and-play lighting device.

According to an embodiment at least part of the driver circuitry of the lighting device is in thermal communication with the light source. Advantageously the driver circuitry and the light source may compensate for each other's temperature and thereby reduce the risk of overheating the lighting device.

According to an embodiment the lighting device is compatible with a power over Ethernet standard. Advantageously such a lighting device may be in direct communication with a power over Ethernet compliant power source equipment without intermediate interfaces or converters.

It is noted that the invention relates to all possible combinations of features recited in the claims.

BRIEF DESCRIPTION OF THE DRAWINGS

This and other aspects of the present invention will now be described in more detail, with reference to the appended drawings showing embodiment(s) of the invention.

DETAILED DESCRIPTION

Figure 1A:
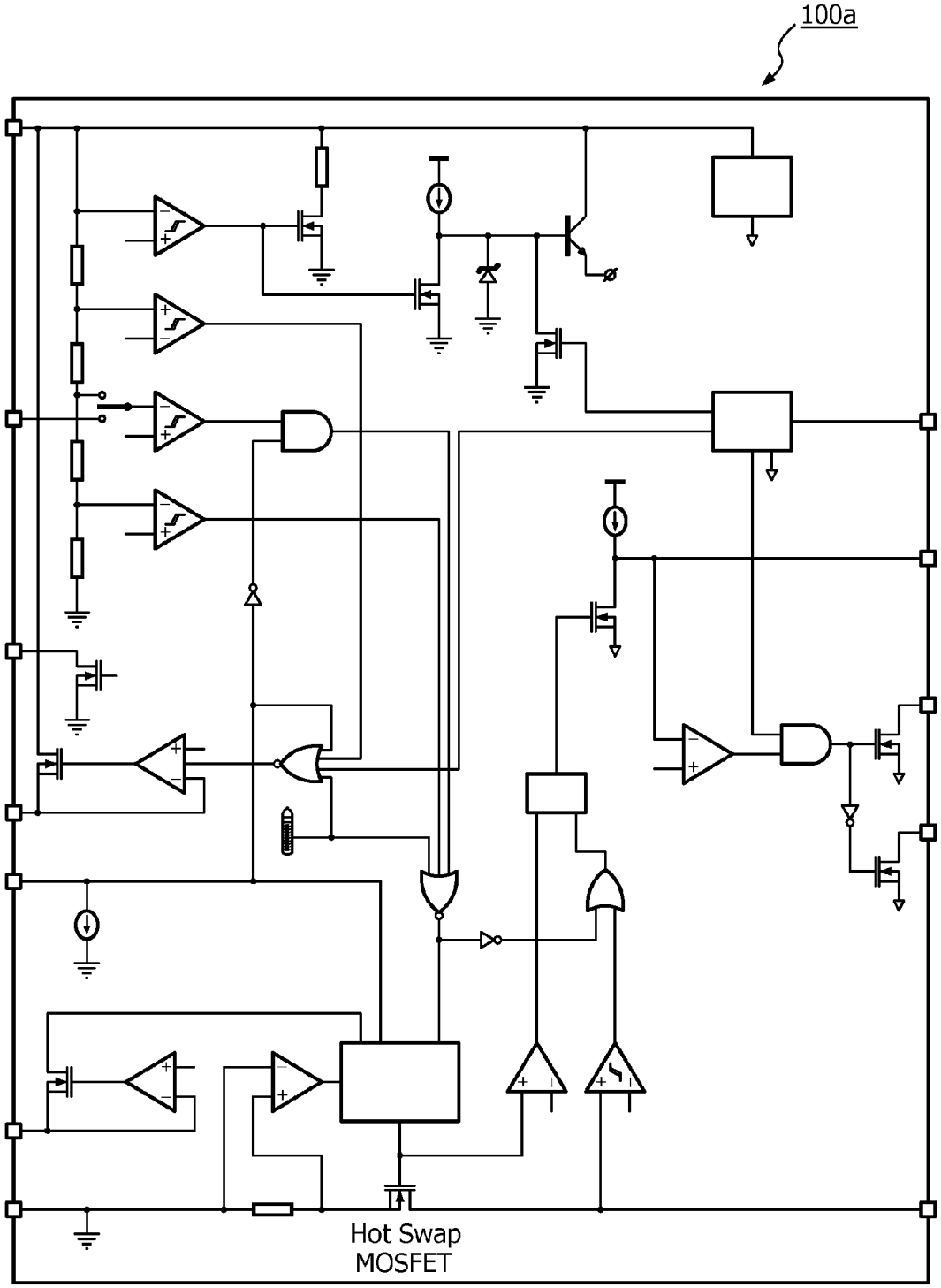
FIG. 1a (Prior Art)
FIG. 1*a*-1*b* are schematic illustration of prior art circuits.

The below embodiments are provided by way of example so that this disclosure will be thorough and complete, and will fully convey the scope of the invention to those skilled in the art. Like numbers refer to like elements throughout.

The Power over Ethernet standard (IEEE 802.3af) defines the interaction between power sources, or power sourcing equipment (PSE), and loads, or power devices (PDs). PDs are classified by the amount of power they consume. Ethernet ports on PSE may supply a nominal 48 V DC power on the data wire pairs or on the "spare" wire pairs, but not both. According to prior art, a PSE must never send power to a device that does not expect it. PoE is managed by a multi-stage handshake protocol to protect equipment from damage and to manage power budgets. One Ethernet cable can transport both data and power to the PD. For example, the load may be a building control device. Thus the building control device may receive both supply voltage and data via a Power over Ethernet cable. The load may also be a lighting device. Thereby the data supplied via the Power over Ethernet cable may be used to control properties of the lighting device.

The PSE probes the PD to see if it is IEEE 802.3af compliant. To support the PoE-standard, the PD has to signalize that it is capable of receiving power. According to state of the art the power consumption of the PD should be limited to a maximum allowed value (e.g. 350 mA), otherwise the PSE will defect a fault and deactivate the power flow to the load.

The PSE then forces a classification voltage (typically between 15 V and 20 V) and the PD responds by drawing a specific current to identify itself in a power class according to a predefined table. Such a table may classify power devices into e.g. class 0, class 1, class 2, class 3 and class 4. However, other classifications may be used as well.

According to prior art a separate circuit, a so-called PD controller, is provided as an interface between the PSE and the PD. PD controllers are typically implemented as integrated circuits. These PD controllers are arranged to signalize the PoE capability of the PD and to ensure of keeping the power flow to and from the PD within the allowed limits. Thus, the PD controllers may act as intermediate power processing devices. As a result, the PD controllers add cost, volume and losses to the circuitry.

Figure 1B:
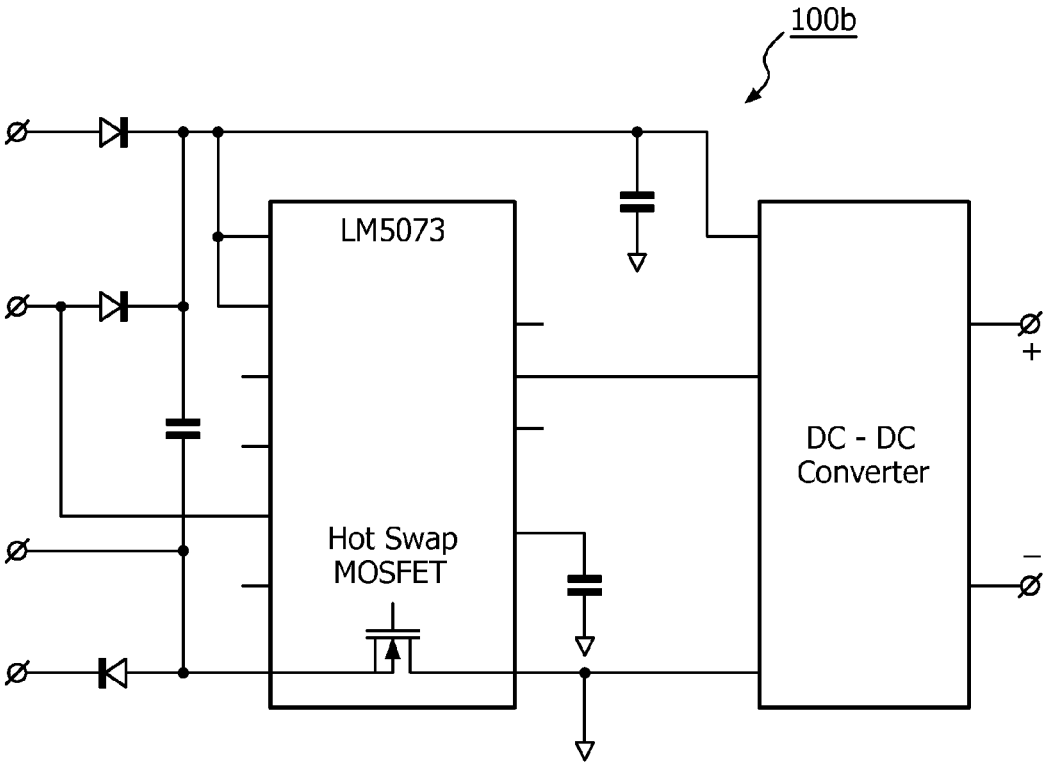
FIG. 1b (Prior Art)

One example of such a PD controller is the LM5073 circuit from National Semiconductor. A schematic diagram of this circuit is illustrated at reference numeral 100*a* in FIG. 1*a*. The circuit 100*a* may thus be connected to the powered device (PD), possibly in combination with additional interface circuitry, and hence provides an interface to the power sourcing equipment (PSE). A detailed description of the circuit 100*a* is available in the literature and is therefore here omitted. The general purpose of providing an illustration of the circuit 100*a* is to give an overview of the overall functionality associated therewith. In principle the circuit 100*a* works as follows. Firstly the voltage levels presented to the input terminals by the PSE are measured. If there are certain values present, the circuit 100*a* "responds" to these input signals. During detection, the PSE wants to measure an impedance of 25 kOhm within the detection voltage range, so current is a function of voltage. During classification, the PSE want to measure a certain fixed current within the classification voltage range so the current is fixed, i.e. not a function of voltage. So, the PD has to "perform" like a resistor or a current sink. If these steps have been executed successfully, the PSE applies full power (voltage) to the PD. Then, the circuit 100*a* monitors voltage levels and current flow to guarantee that the PD stays within the limits of the PoE standard. The input voltage is transferred (via a MOSFET switch, in FIG. 1*a* denoted Hot Swap MOSFET) to the output terminal (or limited, or even cut off, if the limits are exceeded). FIG. 1*b* illustrates a system 100*b* where the LM5073 circuit 100*a* of FIG. 1*a* is connected as an interface between a PSE device and a DC-DC converter acting as a load. The DC-DC converter may in turn be connected to second load, such as a lighting device. The DC-DC converter will comprise own supervision circuitry, power switches, and the like, so the increased effort and dual power processing is clear from this illustration.

According to the present invention there is provided a lighting device which is powered via Power over Ethernet and where a driver of the lighting device is directly compatible with the PoE standard. The driver already embedded in the light source may thus realize a part of the functionality which according to state of the art is embedded in the separate PD controller. As a result, the disclosed light source will be more cost effective and more energy efficient.

Figure 2:
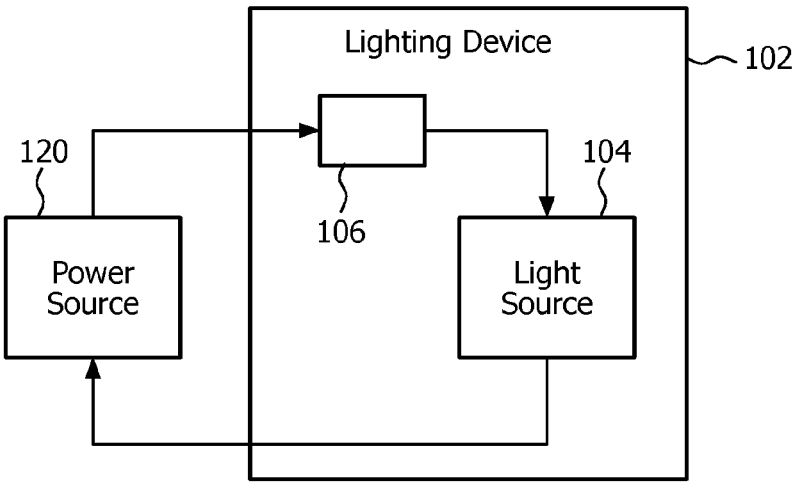
FIGS. 2-5 are schematic illustrations of lighting devices according to embodiments.

FIG. 2 shows a lighting device 102 according to an embodiment. The lighting device 102 comprises a light source 104, e.g. an array of LEDs, and driver circuitry 106. The driver circuitry 106 enables the lighting device 102 to operate in a classification mode, i.e. to conduct a first predefined current within at least one predefined classification current range upon receiving a classification voltage within a classification voltage range. The classification voltage may be provided by a power source 120. Preferably the power source 120 is a power over Ethernet power source device. Preferably the lighting device 102 is compatible with a power over Ethernet standard, such as IEEE 802.3af. The lighting device 102 further comprises driver circuitry 106 enabling the lighting device 102 to operate in normal operation mode, i.e. to conduct a second predefined current upon receiving an operation voltage, wherein an input power of the operation voltage is within at least one predefined power consumption class, and wherein power consumption is in accordance with the classification current range. The at least one predefined power consumption class and the at least one predefined classification current range may be determined by properties of the power source. To support detection of the PD, further circuitry might be required.

According to an embodiment the lighting device comprises a linear regulator circuit, such as a perfectly matched diode. Thereby a current consumption amount in the classification and in the operation voltage range may be defined by forward voltage characteristics of the light source.

Figure 6:
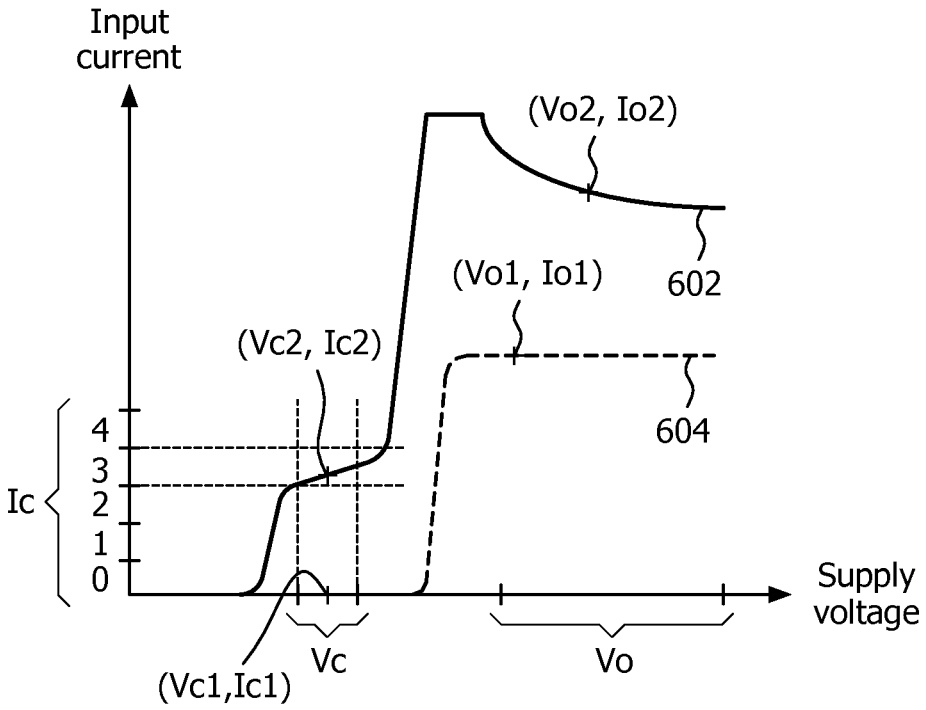
FIG. 6 illustrates input current as a function of supply voltage for lighting devices according to embodiments.

According to an embodiment, the driver circuitry 106 will be part of a light driver comprising a step-up converter (boost), which is designed to handle the full light source power during normal operation (during which approximately 37 V to 56 V are supplied to the light source 104). At lower voltage levels, the internal over current limitation of the driver circuitry 106 may not allow consuming the full current but will limit the current consumption. This could allow using this lower current consumption to indicate the power level of the lighting device 102 (acting as PD) towards the power source 120 (acting as PSE). A possible input current characteristics of suitable driver circuitry according to this embodiment is schematically illustrated in FIG. 6, which will be described below.

According to an embodiment, the driver circuitry will be part of a light driver comprising a step-down converter (buck). In this case the forward voltage of light source can be used during the classification to indicate a class 0 device from the above mentioned classes of devices. To indicate this class, zero or almost zero current may be conducted by the PD during classification. Driver circuitry 106 associated with such characteristics may be enabled by selecting the forward voltage of the light source 104 to be higher than the classification voltage range. Consequently, the step-down converter does not draw any significant input current. However, during normal operation, the supply voltage is higher than during classification. By selecting the voltage over the light source 104 to be lower than the minimum supply voltage, the step-down converter can drive the desired current during normal operation into the light source 104. A possible input current characteristics of suitable driver circuitry according to this embodiment is schematically illustrated in FIG. 6, which will be described below.

Figure 3:
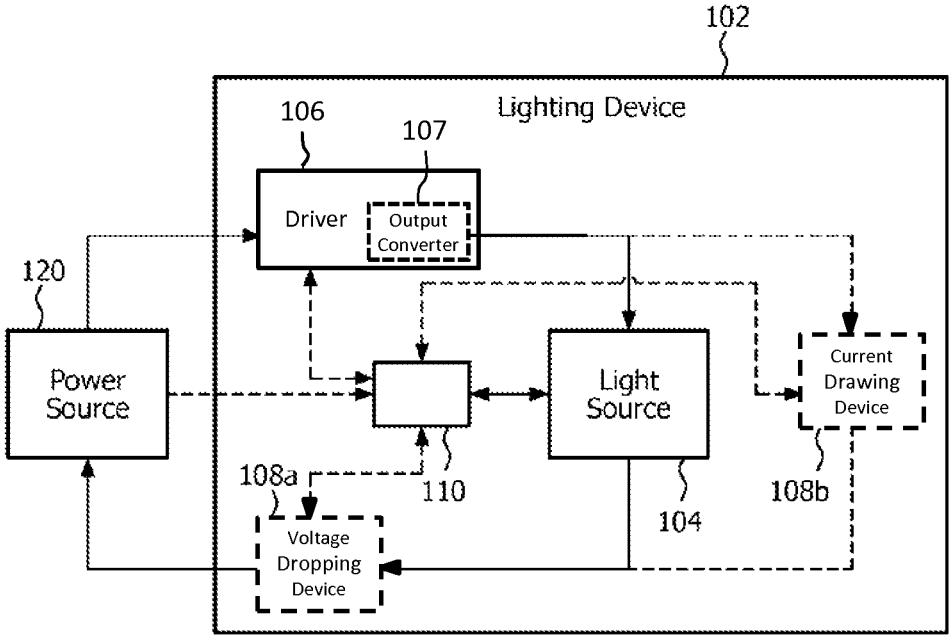

Similarly to the embodiment wherein the light driver comprises a step-down converter for indicating a class 0 PD, a light driver comprising a step-down converter can also be used according to another embodiment wherein the light source 104 is ballasted with a resistor or with a linear current source (see FIG. 3). Such an embodiment could be suitable for very low cost PoE lighting devices 102 not having any remote control features. In such applications, the light source 104 does not need to have a data interface towards the Ethernet. Only a local user interfaces (in the simplest version a switch) or a presence detection unit may be operatively connected to the light source 104.

In general, in addition to the above mentioned linear circuit, step-up converter and step-down converter, there may be several other types of suitable converters (such as a switched capacitor, Cuck, Sepic, Flyback, Forward, Push-Pull, Half bridge, and other converters).

FIG. 3 shows a lighting device 102 according to an embodiment. As in FIG. 2 the lighting device 102 comprises a light source 104, such an array of LEDs, and driver circuitry 106. The lighting device 102 further comprises an optional voltage dropping device 108*a*. The voltage dropping device 108*a* is connected in series with the light source 104. Thereby a current consumption amount in classification and in the operation voltage range may be defined by a property of the voltage dropping device 108*a*. For example, the light source 104 alone could conduct too much power/current, because a) it could start drawing current at too low voltages (e.g. already during detection) or too much current during classification, or b) current consumption may increase too much with increasing input voltage, thereby exceeding the current or power limits in the upper regions of the operation voltage range. The voltage dropping device 108*a* is provided in order to reduce the voltage across the light source 104 and thereby to prevent or at least mitigate these issues.

The lighting device 102 further comprises an optional current consuming device 108*b*. The current consuming device 108*b* is connected parallel to the light source 104. Thereby a current consumption amount in classification and in the operation voltage range may be defined by a property of the current consuming device 108*b*. The light source 104 alone could conduct too little power/current, because a) it could start drawing current at too high voltages (e.g. it could not conduct current at the minimum operation voltage), or b) current consumption may increase too little with increasing input voltage, e.g. by drawing the right current during classification but not enough current during operation. The current consuming device 108*b* is provided in order to allow current flow in parallel to the light source 104 and thereby to prevent or at least mitigate these issues.

The lighting device 102 may further comprise an optional power converter 107 .The optional power converter 107 may be part of the driver circuitry 106. Thereby a current consumption amount in classification and in the operation voltage range may be defined by characteristics of the power converter 107. The power converter 107 may be a switch mode power converter. The power converter 107 is configured to deliver an output voltage, which differs from the input voltage, to the light source. The power converter 107 may thus be regarded as replacing a power converter stage (with monitoring and current limiting functionality) which is designed to deliver the same voltage to the load (i.e. to the light source 104) as the input voltage (having as little loss in the series switch as possible).

The lighting device 102 may further comprise an energy store 110. The energy store 110 is arranged to store power delivered by the power source 120. The energy store 110 may then provide the light source 104 with the stored power. That is, when the energy store 110 stores power the light source 104 may only receive a small amount of supply power. Thereby the supplied power to the light source 104 may be dependent on properties of the energy store 110. Similarly, the energy store 110 may provide stored power to other devices and/or dedicated circuitry in the lighting device 102, such as the driver circuitry 106, the voltage dropping device 108*a* and/or the current consuming device 108*b*.

Figure 4:
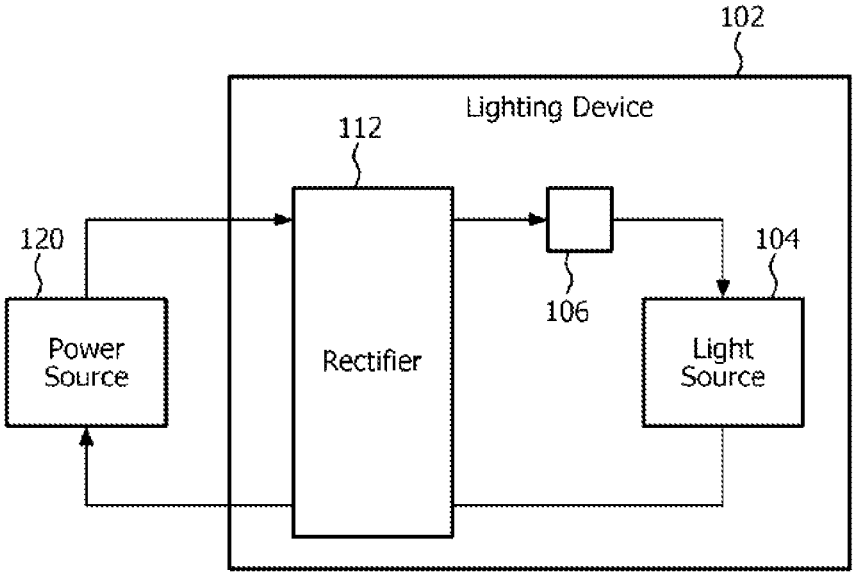

The light source 104 may only be able to conduct a direct current (DC) of predefine polarity. In case the power source 120 delivers a direct current (DC) of undefined polarity, an alternating current (AC) or power from more than two input signals which have to be decoupled, this current needs to be converted into a direct current of proper polarity in order for the light source 104 to be able to conduct the current. FIG. 4 shows a lighting device 102 according to an embodiment. As in FIGS. 2 and 3 the lighting device 102 comprises a light source 104, such an array of LEDs, and driver circuitry 106. The lighting device 102 further comprises a rectifier 112. The rectifier 112 is arranged to rectify input current conducted by the lighting device. That is, the rectifier 112 is arranged to convert an AC supply voltage, or power from more than two input signals which have to be decoupled, into a DC supply voltage of proper polarity. Thereby the light source 104 may be able to conduct the current delivered by the power source 120 although the power source 120 delivers alternating current or direct current with undefined polarity (see above). According to the present embodiment the rectifier 112 is part of the lighting device 102. The rectifier 112 may, in view of the light source 104, be arranged before or after the driver circuitry 106. To support powering via multiple signals (or pairs of signals from a PSE), the rectifier 112 may comprise multiple inputs (not shown).

Together with the power, data may also be delivered to the lighting device 102 (via an Ethernet cable) from the power source 120. This data may thus be received and interpreted by the lighting device 102. Hence if, at the power source side, control information (dimming value, color point, power level etc.) is sent to the light source, such information can be captured by the lighting device 102. Based on such received information, low power control signals (e.g. a PWM signal where the duty cycle includes the intensity information, or a digital on/off signal at TTL or CMOS voltage level) can be handled directly by the lighting device 102.

Figure 5:
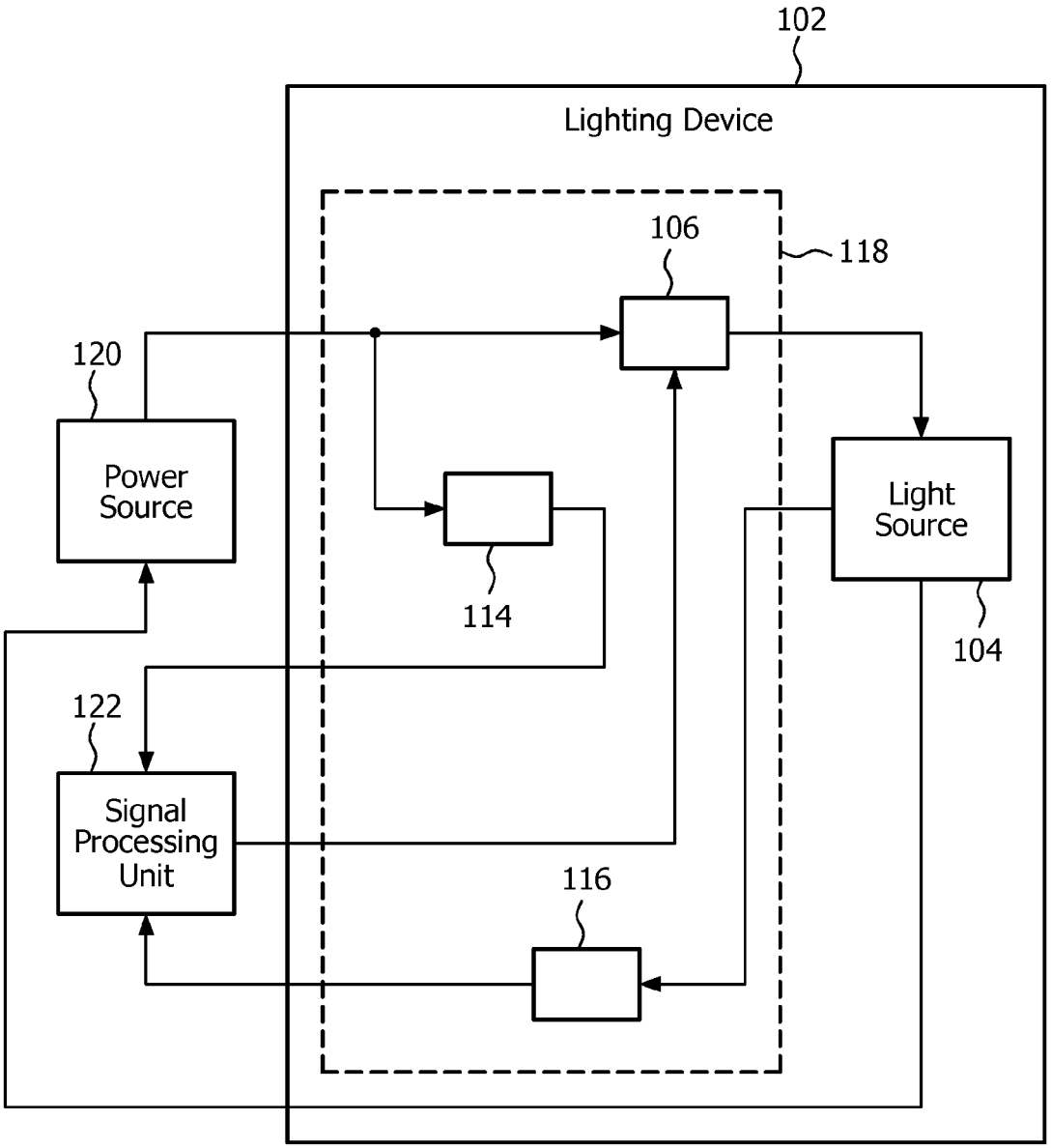

FIG. 5 shows a lighting device 102 according to an embodiment. As in FIGS. 2, 3 and 4 the lighting device 102 comprises a light source 104, such an array of LEDs, and driver circuitry 106. According to an embodiment the lighting device 102 further comprises driver circuitry 114 configured to scale the input power (delivered to the lighting device 102 e.g. from the power source 120) to an output power. A signal processing unit 122 may then be provided with the output power. The signal processing unit 122 may be (part of) a micro controller (μC). The signal processing unit 122 may be part of the lighting device 102, or, as in FIG. 5, be operatively connected to the lighting device 102. Using such a signal processing unit 122 control information sent by the power source 120 may be interpreted and utilized by the lighting device 102. In other words, the driver circuitry 106 may be arranged to, from the signal processing unit 122, receive a control signal pertaining to control information sent by the power source 120, and to adapt the behavior (dimming value, color point, power level etc.) of the light source 104 according to the control signal. The control signal may comprise modulated data. The modulated data may be associated with a digital control data signal and comprise data associated with a property of the light source 104.

The lighting device 102 may further comprise driver circuitry 116 configured to measure at least one property of the lighting device 102. The measurement may then be provide to the signal processing unit 122. The measurement may pertain to the temperature of the light source 104. Thereby the signal processing unit 122 may be provided with temperature information of the light source 104. This may prevent overheating of the light source 104, assuming that the signal processing unit 122 is capable of communicating light source settings to the driver circuitry 106. Thereby the driver circuitry 106 may decrease the current consumption of the light source 104 and thereby preventing the light source 104 from overheating. Alternatively, a control command may be transmitted to the energy store 110. By reducing the time duration during which the energy store 110 provides the light source 104 with power the average current consumption of the light source 104 may be reduced and thereby the light source 104 may be prevented from overheating. Alternatively the information is delivered to other components within the Ethernet, e.g. to the powering PSE.

Further, as schematically indicated by the dashed line in FIG. 5 the driver circuitry 106, the driver circuitry 114 and the driver circuitry 116 may be part of a common light driver 118.

At least part of the driver circuitry 106, 114, 116, 118 of the lighting device 102 may be in thermal communication with the light source 104. Thereby the light source 104 and the driver circuitry 106, 114, 116, 118 may be able to compensate for each other's temperature effects. For example, the driver circuitry 106, 114, 116, 118 may function as a cooler for the light source 102 and vice versa. As a example, the light source 104 may comprise LEDs which are mounted on a thermally conductive substrate (e.g. a metal core printed circuit board (PCB)). Due to some optical constrains (such as required dimension of the area which is populated with LEDs) the cooling capability of this large substrate may be higher than the required amount of cooling for the LED losses. Then, other components of the lighting device 102 can also use the cooling capabilities of the LED substrate.

FIG. 6 illustrates input current characteristics of suitable driver circuitry according to embodiments. In the figure input current is plotted as a function of supply voltage. On the supply voltage axis a classification voltage range Vc is identified as well as a normal operation voltage range Vo. The classification voltage range Vc is used during classification, as explained above. During normal operation of the light source a supply voltage Vo1, Vo2 in the normal operation voltage range Vo is supplied. Similarly, on the input current axis a number of classification classes and corresponding classification current ranges Ic have been identified. The classification current classes are schematically denoted class 0, class1, . . . , class 4. The axes of the figure are not necessarily to scale. The current consumption during detection is not shown here.

The solid line 602 illustrates typical input-output behavior for driver circuitry 106 comprising a step-up converter. The driver circuitry is selected such that the under voltage lockout (UVLO) of the step-up converter controller IC is higher than the detection voltage range but lower than the classification voltage. When classification voltage is applied the converter can feed some current Ic2 to the light source 104, but the converter operates in a current limiting mode (because input voltage is too low to deliver full power to the light source 104). In the figure such a working point is schematically illustrated at (Vc2,Ic2). During normal operation the input current Io2 is determined by the power to be delivered to the light source 104. In the figure such a working point is schematically illustrated at (Vo2,Io2). With increasing voltage, input current is reduced to keep the power at a constant level. Therefore the input current may decrease as supply voltage Vo2 increases in the normal operation voltage range Vo. The light source voltage, the UVLO, and the current limits have to be selected correctly in order to achieve the desired characteristics.

The dashed line 604 illustrates typical input-output behavior for driver circuitry 106 comprising a linear regulator. The linear regulator is set to deliver constant output current Io1 to the light source 104. As long as the supply voltage Vo1 is lower than the forward voltage (hereinafter denoted Vf) of the light source 104, no current will flow. In the figure such a working point is schematically illustrated at (Vc1,Ic1). As soon as Vo1>Vf, current flow starts. If (Vo1−Vf)>Vdropout, where Vdropout denotes the minimum voltage drop across the linear regulator needed to deliver full current, the input and output current Io1 will be constant. In the figure such a working point is schematically illustrated at (Vo1,Io1). Vf has to be selected correctly, i.e. Vc1<(Vf−Vdropout) <Vo1_operation_minimum, where Vc1 is the classification voltage and where Vo1_operation_minimum is the minimum supply voltage.

In case the driver circuitry 106 comprises a step-down converter the input-output behavior for driver circuitry 106 would be a combination of the behavior for the driver circuitry 106 comprising a step-up converter and the driver circuitry 106 comprising a linear regulator. During classification, the input-output behavior would be similar to the behavior of the dashed line 604 (i.e. the current Ic1 would, when a classification voltage Vc1 is applied, be at least close to zero, indicating classification class would be class 0). During normal operation the input-output behavior would be similar to the solid line 602 (i.e. the current Io2 will decrease as the input voltage Vo2 increases).

In general, the value of the input current at a certain operation voltage is mostly determined by the application (and should be in accordance to the announced power level during classification) but is not so much determined by the type of used converter.

The person skilled in the art realizes that the present invention by no means is limited to the preferred embodiments described above. On the contrary, many modifications and variations are possible within the scope of the appended claims.

The invention claimed is:

1. A lighting device comprising at least one light source, the lighting device comprising driver circuitry to:

conduct a first predefined current within at least one predefined classification current range upon receiving a classification voltage within a classification voltage range, and conduct a second predefined current upon receiving an operation voltage, wherein a power consumed at the operation voltage is within at least one predefined power consumption class, the classification current range being associated with the power consumption class, wherein the first predefined current and the second predefined current are defined by at least one from a group of forward voltage characteristics of the light source, a property of a voltage dropping device connected to the lighting device, a property of a current drawing device connected to the lighting device and characteristics of a power converter configured to deliver an output voltage, which differs from the input voltage, to the light source.

2. The lighting device according to claim 1, further comprising the voltage dropping device, wherein the voltage dropping device is connected in series with the at least one light source, wherein the first predefined current and the second predefined current are defined by the property of the voltage dropping device.

3. The lighting device according to claim 1, further comprising the current drawing device, wherein the current drawing device is connected parallel to the at least one light source, wherein the first predefined current and the second predefined current are defined by the property of the current drawing device.

4. The lighting device according to claim 1, wherein the first predefined current and the second predefined current are determined by properties of the at least one light source.

5. The lighting device according to claim 1, wherein the lighting device is arranged to receive power from a power source, and wherein the at least one predefined power consumption class and the at least one predefined classification current range are determined by properties of the at least one light source.

6. The lighting device according to claim 5, wherein the power source is a power over Ethernet power source device.

7. The lighting device according to claim 5, further comprising an energy storage arranged to selectively store power and power the at least one light source.

8. The lighting device according to claim 7, further comprising driver circuitry configured to:

scale the input power to an output power;

provide a signal processing unit with the output power;

from the signal processing unit, receive a control signal pertaining to a power level of the light source; and adapt the output power to the at least one light source according to the control signal.

9. The lighting device according to claim 8, wherein the control signal comprises modulated data.

10. The lighting device according to claim 9, wherein the data is associated with a property of the at least one light source.

11. The lighting device according to claim 8, further comprising driver circuitry configured to:

measure at least one property of the lighting device; and provide the signal processing unit with the measurement.

12. The lighting device according to claim 11, wherein the driver circuitry comprises a switched mode power supply selected from a group consisting of a step-up converter and a step-down converter.

13. The lighting device according to claim 11, further comprising a rectifier arranged to rectify input current conducted by the lighting device.

14. The lighting device according to claim 11, wherein at least part of the driver circuitry of the lighting device is in thermal communication with the at least one light source.

15. The lighting device according to claim 11, wherein the lighting device is compatible with a power over Ethernet standard.

16. A lighting device comprising:

at least one light source; and a light driver configured to drive the light source, wherein the light driver is configured to conduct a classification current within a predefined classification current range upon receiving a classification voltage within a predefined classification voltage range, and to conduct an operating current upon receiving an operation voltage, wherein a power consumed at the operation voltage is within a predefined power consumption class, the classification current range being associated with the power consumption class, and wherein the classification current depends at least in part on a first current supplied by the lighting driver to the at least one light source in response to the classification voltage, and the operating current depends at least in part on a second current supplied by the lighting driver to the at least one light source in response to the operation voltage.

17. The lighting device of claim 16, wherein the at least one light source comprises at least one light emitting diode (LED) and wherein the classification current and the operating current depend at least in part on a forward voltage characteristics of the one or more LEDs.

18. The lighting device of claim 16, further comprising a voltage dropping device connected in series with the at least one light source, wherein the classification current and the operation current each depend at least in part on a property of the voltage dropping device.

19. The lighting device of claim 16, further comprising a current drawing device connected in parallel to the at least one light source, wherein the classification current and the operation current each depend at least in part on a property of the current drawing device.

20. The lighting device of claim 16, wherein the predefined classification current range and the predefined power consumption class are determined by properties of the at least one light source.

* * * * *